US006429731B2

(12) United States Patent
Böhm et al.

(10) Patent No.: US 6,429,731 B2
(45) Date of Patent: Aug. 6, 2002

(54) CMOS VOLTAGE DIVIDER

(75) Inventors: Thomas Böhm, Zorneding; Robert Esterl, München; Stefan Lammers, Heek, all of (DE); Zoltan Manyoki, Cdn-Kanata (CA)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 09/816,934

(22) Filed: Mar. 23, 2001

(30) Foreign Application Priority Data

Mar. 23, 2000 (DE) ..... 100 14 385

(51) Int. Cl.[7] ..... G05F 1/595
(52) U.S. Cl. ..... 327/541; 327/576; 323/313
(58) Field of Search ..... 327/541, 543, 327/576, 581; 323/313

(56) References Cited

U.S. PATENT DOCUMENTS

| | | | | |
|---|---|---|---|---|
| 4,675,557 A | | 6/1987 | Huntington | |
| 4,847,518 A | * | 7/1989 | Leidich | 327/541 |
| 5,046,052 A | * | 9/1991 | Miyaji et al. | 365/189.09 |
| 5,187,429 A | * | 2/1993 | Phillips | 323/314 |
| 5,923,212 A | * | 7/1999 | Womack | 327/541 |
| 5,936,436 A | * | 8/1999 | Kuroda | 327/81 |
| 5,973,534 A | * | 10/1999 | Singh | 327/309 |

FOREIGN PATENT DOCUMENTS

| | | | |
|---|---|---|---|
| DE | 30 26 361 C2 | 6/1990 | H01L/23/58 |
| DE | 37 13 107 C2 | 8/1995 | G05F/3/16 |

OTHER PUBLICATIONS

Anonymous, "Programmable resistor voltage divider that saves area in the physical construction used in an integrated circuit", IBM Research Disclosure 430131, Feb. 2000, XP–002171703.

* cited by examiner

*Primary Examiner*—Toan Tran
*Assistant Examiner*—Terry L. Englund
(74) *Attorney, Agent, or Firm*—Laurence A. Greenebrg; Werner H. Stemer; Ralph E. Locher

(57) ABSTRACT

A CMOS voltage divider having a first chain containing series-connected MOS transistors of a first conductivity type is described. Each of the MOS transistors have identical geometrical dimensions and, at the same time, each have identical gate-source voltages. The MOS transistors operate in the linear range of their characteristic curve and between opposite ends of the first chain an input voltage to be divided is present and at whose source terminals the voltage fractions can in each case be picked off. Provision is made of a second chain containing series-connected MOS transistors, complementary to the first MOS transistors. The second chain has the same number of transistors as the first MOS transistors and with the same geometrical dimension in each case. The MOS transistors of the first chain are connected to the MOS transistors of the second chain in such a way that each MOS transistor chain generates the gate-source bias voltage for the respective other MOS transistor chain.

3 Claims, 1 Drawing Sheet

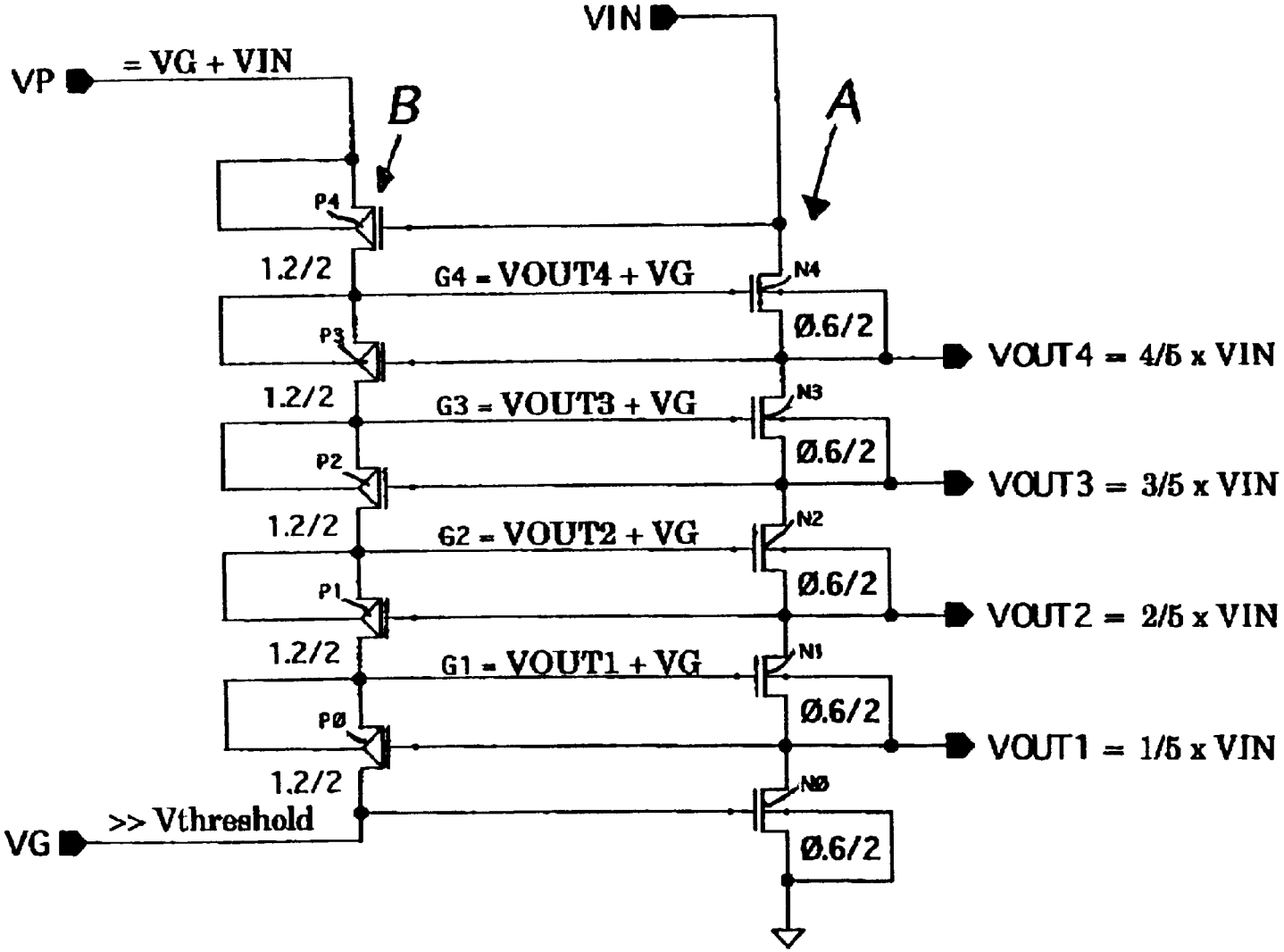
VIN
A
B
VP
= VG + VIN
VG
>> Vthreshold
P4
P3
P2
P1
P0
1.2/2
1.2/2
1.2/2
1.2/2
1.2/2
G4 = VOUT4 + VG
G3 = VOUT3 + VG
G2 = VOUT2 + VG
G1 = VOUT1 + VG
N4
N3
N2
N1
N0
Ø.6/2
Ø.6/2
Ø.6/2
Ø.6/2
Ø.6/2
VOUT4 = 4/5 x VIN
VOUT3 = 3/5 x VIN
VOUT2 = 2/5 x VIN
VOUT1 = 1/5 x VIN

CM OS VOLTAGE DIVIDER

BACKGROUND OF THE INVENTION

Field of the Invention

The present invention relates to a CMOS voltage divider having a first chain containing series-connected MOS transistors of a first conductivity type. Each of the transistors have identical geometrical dimensions and, at the same time, each have identical gate-source voltages, which operate in the linear range of their characteristic curve and between whose opposite ends an input voltage to be divided is present and at whose source terminals the voltage fractions can in each case be picked off.

Generally, a voltage divider circuit contains a plurality of series-connected resistance elements through which the same current flows. The divided output voltages can be picked off at the junction points of the resistance elements of the resistance chain.

If such a voltage divider circuit is intended to be used in a large scale integrated circuit, it must satisfy a number of requirements. First, an area occupied by the voltage divider circuit should be as small as possible. Second, the output voltage should depend only on the circuit geometry. Third, the quiescent current drawn by the circuit should be as small as possible. Fourth, the output resistance of such a voltage divider chain should be as low as possible in order that the circuit acts as a voltage source.

In the prior art, voltage divider circuits are known which fulfill at least some of the above requirements and use resistance elements. The resistance elements are produced either in N-type diffusion or in P-type diffusion and their sheet resistance is in the range of 10–100 ohms/unit of area. Therefore, an extremely large resistance area of the order of magnitude of 10,000 units of area is needed in order to achieve a resistance of $10^6$ ohms which, for its part, brings about a quiescent current of just a few $\mu$A. In many cases, such a large chip area is impossible or undesirable. Therefore, a voltage divider circuit of this type does not fulfill the first and third requirements.

Another possible realization of a voltage divider circuit uses MOS transistors operating in their linear range as resistance elements. The current through each transistor depends on its geometry and on its terminal voltages:

$$I_{LIN}=\text{Beta}\times[(V_{gs}-V_{th})V_{ds}-V_{ds}^2/2].$$

In this relationship, $V_{gs}$, $V_{ds}$ and $V_{th}$ respectively represent the gate-source voltage, the drain-source voltage and the threshold voltage. Beta depends on the production process and on the width-length ratio of the transistor. The output voltages of the voltage divider circuit depend on the process used (on account of $V_{th}$) and depend nonlinearly on the transistor dimensions. Therefore, the second requirement mentioned above is not fulfilled.

SUMMARY OF THE INVENTION

It is accordingly an object of the invention to provide a CMOS voltage divider that overcomes the above-mentioned disadvantages of the prior art devices of this general type, which can be realized without passive components, such as resistors or capacitors, and can generate uniformly spaced output voltages from an applied input voltage while fulfilling the first through fourth requirements mentioned above.

With the foregoing and other objects in view there is provided, in accordance with the invention, a CMOS voltage divider. The CMOS voltage divider contains a first chain formed of series-connected first MOS transistors of a first conductivity type. Each of the first MOS transistors have identical geometrical dimensions and identical gate-source voltages. The first MOS transistors operate in a linear range of their characteristic curve and an input voltage to be divided is impressed between opposite ends of the first chain. The first MOS transistors furthermore have source terminals where voltage fractions of the input voltage can be picked off. A second chain formed of series-connected second MOS transistors of a second conductivity type being complementary to the first conductivity type is provided. The number of the second MOS transistors equals the number of the first MOS transistors. The second MOS transistors have the same geometrical dimensions in each case. The first MOS transistors are connected to the second MOS transistors such that each of the first MOS transistors of the first chain generates a gate-source bias voltage for a respective one of the second MOS transistors of the second chain and each of the second MOS transistors of the second chain generates the gate-source bias voltage for a respective one of the first MOS transistors of the first chain.

The transistors have the same size, that is to say that they are matched to one another, and therefore have identical gate-source voltages. Since they are connected in series with one another, their drain-source voltages are also identical. Moreover, the drain-source voltage is independent of process and temperature.

The invention achieves the above object by exclusively using mutually complementary MOS transistors of the N and P conductivity types. This reduces the area requirement, requires only an extremely small quiescent current and has only a very small output resistance, which, after all, is characteristic of CMOS technology. Furthermore, the output voltage depends only on the geometry of the circuit.

In accordance with the invention, the P-channel MOS transistors have drain terminals and gate terminals, and the N-channel MOS transistors have gate terminals and drain terminals. Each of the drain terminals of the N-channel MOS transistors is connected to a respective one of the gate terminals of the P-channel MOS transistors and each of the drain terminals of the P-channel MOS transistors is connected to a respective one of the gate terminals of the N-channel MOS transistors. The second chain has a source end to be connected to a first supply voltage and a drain end to be connected to a second supply voltage, and the following holds true:

$$VG>>V_{threshold};\ VP=VG+V_{IN},$$

where:

$V_{threshold}$ denotes a maximum value of a threshold voltage of the N-channel and the P-channel MOS transistors;

$V_{IN}$ denotes the input voltage to be divided;

VP is the first supply voltage; and

VG is the second supply voltage.

Other features which are considered as characteristic for the invention are set forth in the appended claims.

Although the invention is illustrated and described herein as embodied in a CMOS voltage divider, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The single FIGURE of the drawing is an exemplary circuit diagram of a voltage divider circuit that can generate four uniformly divided output voltages from an input voltage.

DESCRIPTION OF THE PREFERRED EMBODIMENTS

Referring now to the single figure of the drawing in detail, there is shown a CMOS voltage divider according to the invention and contains two MOS transistor chains A and B. The first transistor chain A has five series-connected N-channel MOS transistors N0–N4, each having identical geometrical dimensions. Since they are connected in series with one another, the transistors N0–N4 also have identical drain-source voltages if their gate-source voltages are identical. The transistors operate in a linear range of their characteristic curve, and an input voltage $V_{IN}$ to be divided is present between a drain end and a source end of the first transistor chain A. Voltage fractions VOUT1–VOUT4 can each be picked off at source terminals of the second to fifth N-channel transistors N1–N4.

The second transistor chain B includes five series-connected P-channel MOS transistors P0–P4, each having identical geometrical dimensions and identical drain-source voltages, assuming that their gate-source voltages are identical.

Each N-channel MOS transistor of the first chain A uses, as a gate-source bias voltage, a voltage fraction generated by the second transistor chain B containing the P-channel MOS transistors P0–P4. Conversely, each P-channel MOS transistor

P0–P4 of the second MOS transistor chain B uses, as a gate-source bias voltage, a voltage fraction generated by the N-channel MOS transistors NO–N4 of the first chain A. In this way, each of the two MOS transistor chains A and B acts as a bias voltage generator circuit for the respective other transistor chain. As shown by the FIGURE, each transistor has a gate-source voltage VG. All of the N-channel transistors have the same geometrical dimension and conduct the same current, since they are connected in series. Therefore, they must also have the same drain-source voltages. The same applies to the P-channel transistors P0–P4 of the second chain B. The following relationships hold true for the supply voltages of the second chain B:

VG>>than a maximum value from {$V_{threshold}$, PMOS; $V_{threshold}$, NMOS}, and VP=VG+$V_{IN}$, where $V_{IN}$ is the input voltage to be divided.

We claim:

1. A CMOS voltage divider, comprising:

a first chain formed of series-connected first MOS transistors of a first conductivity type, each of said first MOS transistors having identical geometrical dimensions and identical gate-source voltages, said first MOS transistors operate in a linear range of their characteristic curve, an input voltage to be divided is impressed between opposite ends of said first chain, and said first MOS transistors have source terminals where voltage fractions of the input voltage can be picked off; and a second chain formed of series-connected second MOS transistors of a second conductivity type being complementary to said first conductivity type, a number of said second MOS transistors equaling a number of said first MOS transistors, said second MOS transistors having a same geometrical dimension in each case, said first MOS transistors connected to said second MOS transistors such that each of said first MOS transistors of said first chain generates a gate-source bias voltage for a respective one of said second MOS transistors of said second chain and each of said second MOS transistors of said second chain generates the gate-source bias voltage for a respective one of said first MOS transistors of said first chain.

2. The CMOS voltage divider according to claim 1, wherein said first MOS transistors are N-channel MOS transistors and said second MOS transistors are P-channel MOS transistors.

3. The CMOS voltage divider according to claim 2, wherein:

said P-channel MOS transistors have drain terminals and gate terminals, said N-channel MOS transistors have gate terminals and drain terminals, each of said drain terminals of said N-channel MOS transistors is connected to a respective one of said gate terminals of said P-channel MOS transistors and each of said drain terminals of said P-channel MOS transistors is connected to a respective one of said gate terminals of said N-channel MOS transistors; and said second chain having a source end to be connected to a first supply voltage and a drain end to be connected to a second supply voltage, and the following holds true:

$$VG>>V_{threshold},\ VP=VG+V_{IN},$$

where:

$V_{threshold}$ denotes a maximum value of a threshold voltage of said N-channel and said P-channel MOS transistors;

$V_{IN}$ denotes the input voltage to be divided;

VP is the first supply voltage; and

VG is the second supply voltage.

* * * * *